United States Patent [19]

Hayden, Jr. et al.

[11] 4,326,701

[45] Apr. 27, 1982

[54] LANCE APPARATUS

[75] Inventors: Ralph P. Hayden, Jr., Upland; Joe M. Barksdale, Ontario, both of Calif.

[73] Assignee: Kaiser Steel Corporation, Oakland, Calif.

[21] Appl. No.: 231,297

[22] Filed: Feb. 4, 1981

Related U.S. Application Data

[63] Continuation of Ser. No. 78,771, Sep. 29, 1979, abandoned.

[51] Int. Cl.[3] ..... C21C 7/02

[52] U.S. Cl. ..... 266/225; 266/267; 266/270; 75/59

[58] Field of Search ..... 266/225, 226, 267, 270; 75/58, 59; 403/DIG. 9

[56] References Cited

U.S. PATENT DOCUMENTS

| | | | |
|---|---|---|---|
| 3,201,103 | 8/1965 | Scherff | 75/59 X |
| 3,627,294 | 12/1971 | Hill | 75/59 X |
| 3,833,209 | 9/1974 | Chang | 266/225 X |
| 3,972,515 | 8/1976 | Mercatoris | 266/225 |

*Primary Examiner*—L. Dewayne Rutledge
*Assistant Examiner*—David Heg
*Attorney, Agent, or Firm*—James E. Toomey

[57] ABSTRACT

This invention relates to an apparatus for delivery of finely divided solids into molten metal. More particularly it relates to a modular lance so constructed and arranged as to inject finely divided reactant and fluxing material, as well as gases, into molten pig iron and the like for desulfurization and other operations compatible with such equipment.

8 Claims, 3 Drawing Figures

LANCE APPARATUS

This application is a continuation of Ser. No. 78,771 filed Sept. 29, 1979, abandoned.

In the prior art equipment for conducting operations of the type contemplated by the present invention the practice is to use a single lance that is of unitary construction. Normally such apparatus has an outer protective cover or refractory material to shield and protect the pipes and other parts of the lance apparatus encased within the refractory sheath from the deleterious effects of the molten pig iron and the like into which it is inserted in normal use. The corrosive effects of the hot metal erode the refractory coating on the lance. The unitary construction of the lance apparatus requires removal of the entire lance apparatus and the shut down and disconnection of the various parts of complicated equipment associated with the lance in its operation. To obtain a monolithic structure of protective refractory the entire worn and used refractory coating must be chipped and otherwise removed from the lance and an entirely new coating applied along its length. Thereafter the lance must be reconnected to the gas and other delivery pipes and associated equipment to enable the lance to be reinserted for reuse in the molten metal as described.

SUMMARY OF THE INVENTION

In the present invention the above objections are overcome by utilizing a lance composed of multiple units or sections. It comprises an apparatus having a lower section and an upper section. The upper section includes cooperating support means for the entire apparatus, and embodies a housing and pipes through which gases and finely divided materials may be fed. The lower section is joined to the upper section so that the pipes and the like through which the gas and other materials may be fed in cooperative relation. The lower section is joined to the upper section so that the pipes and the like through which the gas and other materials flow, constitute an uninterrupted passage. It is encased in a refractory sheath or coating adopted for direct contact with the molten metal so that the corrosive effects of the metal are confined solely to the lower unit. This lower unit is readily disconnected from the upper section without the necessity of connecting and disconnecting hoses or other associated equipment. The entire lance unit is readily removed and otherwise maintained. It is particularly effective for desulfurization of steel.

The invention is described in detail in the following drawings, which depict a preferred embodiment of the invention.

DETAILED DESCRIPTION OF THE INVENTION

Figure 3:
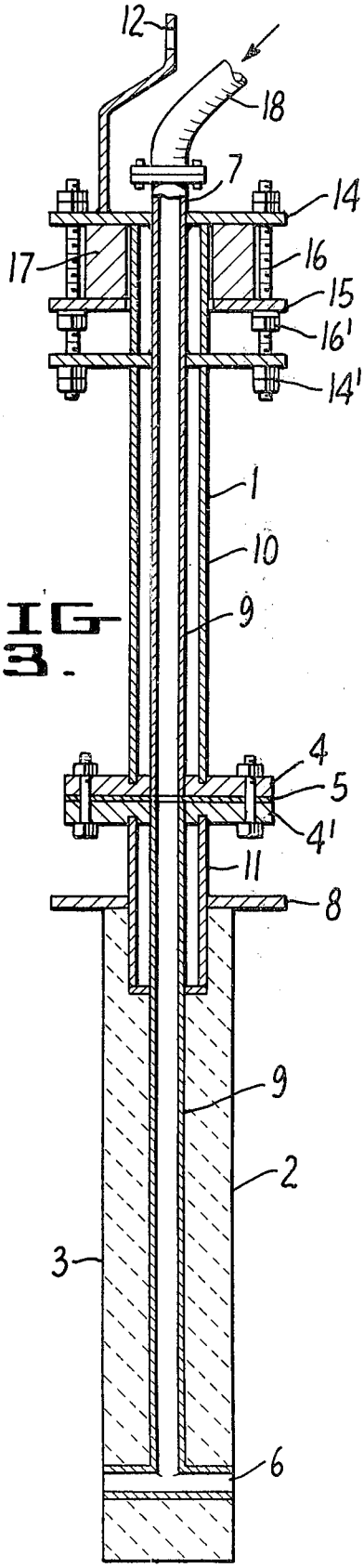
FIG. 3 is a sectional elevation of the lance of the invention showing its essential elements when assembled, including, the releasable connection between the upper and lower sections.

Referring to the drawings wherein a preferred embodiment of the invention is disclosed. The lance apparatus comprises two main units, that is, upper section 1 and lower section 2. These units are connected by abutting flange plates 4 and 4' as shown in FIG. 3, and suitable bolts and gasket arrangements 5.

Each section of the lance has a central pipe 9 which functions as the element for feeding materials through the lance to the hot metal or other material to be treated. The lance apparatus has an opening 6 from which the materials are introduced into bath M. Desirably the orifice 6 is a double opening. The materials, both gases and solids, are fed into the upper end of the lance at entrance 7. A suitable opening is provided in gasket 5 to permit abutting parts of the lance pipe 9 to function as a single unit.

Upper section 1 has an external protective housing or pipe 10 arranged concentrically about pipe 9 and which extends along the entire length of the upper section. An external protective housing 11 is also provided in lower section 2 at its upper end. Housings 10 and 11 not only function as protective means for central lance pipe 9, but also provide increased flexural strength to the overall assembled lance apparatus. It will be noted in the embodiment shown that housing 11 extends to approximately $\frac{1}{3}$ or $\frac{1}{4}$ the length of lower section 2. It is to be understood that the length of housing 11 may be increased or decreased dependent upon the desired column strength of the lance apparatus. Both housings 10 and 11 can also function as cooling chambers for the lance apparatus and a suitable cooling medium either gas or liquid, may be circulated through the open area of each housing by means (not shown) well known to those skilled in the art.

Lower section 2 of the lance apparatus is provided with a refractory cement coating or sheathing of any suitable refractory cement that can readily be applied in plastic or molded form to cover and protect the central lance pipe 9 in lower housing 11.

It will be appreciated as previously stated that lower section 2 is that part of the lance apparatus which when in use is in direct contact with molten steel or other metal that would have a deleterious effect upon the lance and housing if permitted to make direct contact.

Splash guard 8, which in the embodiment shown is a flange-like element, extends radially out from the center of the lance immediately above the refractory cover to prevent molten metal and fluxing materials from fouling the flange plate releasable connection 4 and 4' and the other parts of upper section 1 of the lance apparatus.

Upper section 1 has at its top a sliding bolt clamp assembly 13 which is comprised of upper plate 14, lower plate 14', adjustable plate 15 and cooperating bolts 16 and 16'. This can be readily adjusted, particularly plate 15, to provide openings of requisite size for lifting device 17. The lifting device that has been found useful has a fork like end which permits ready access for insertion of a pair of bars into the clamp so that after adjustment the entire unit or the upper section 1 thereof can be lifted and otherwise moved clear of the ladle as desired. It is apparent from FIG. 1 that the lance, including its upper and lower sections 1 and 2, form no part of the walls of the vessel or ladle L.

Figure 1:
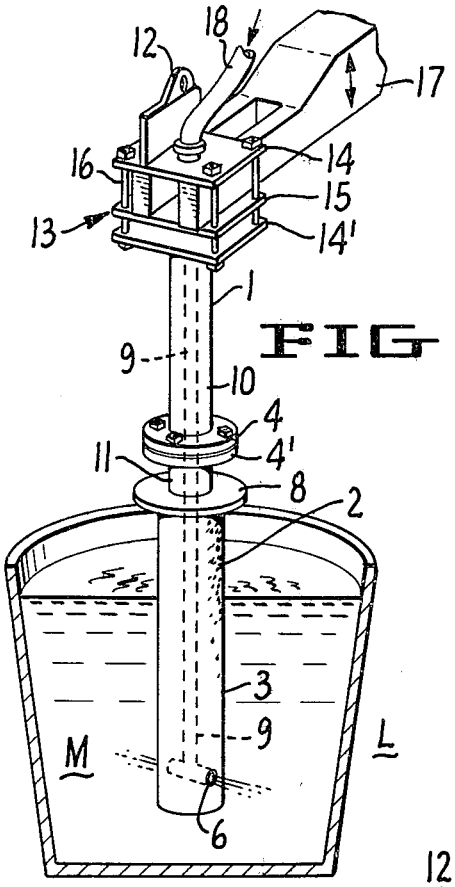
FIG. 1 is a perspective view partly in section of the apparatus of the invention when in use showing a ladle of molten metal and the outline of the main feed pipe through which gaseous and finely divided solids are introduced to the molten steel.

In operation, the lance apparatus when assembled is lifted from its assembly station in the manner heretofore described. Normally this is handled by device 17 which is a lifting means and may be pivoted or otherwise moved to a location over the midpoint of the ladle. It is then lowered into position as shown in FIG. 1. The lifting of the lance apparatus and its movement, along with the movement of lifting means 17, can be assisted by any conventional hoist means which is connected to the apparatus as lift ring 12.

When the lance apparatus is in place for use materials are introduced through insulated flexible hose 18 into entrance 7 of central pipe lance 9. The materials flow out of openings 6 into and beneath the surface of molten metal M of ladle L.

In a desulfurizing operation the reagents which are pneumatically injected into the bath in the manner described above are calcium carbide, or limestone, or quicklime, or mixtures thereof alone or with other materials, for example 90% lime, 5% fluorspar and 5% carbon is one mixture which is quite suitable. The gas that serves as a carrier for the finely divided reagents is of an inert character, and is normally nitrogen, helium or argon and is at a pressure sufficient to entrain the finely divided solids and introduce them into the bath without causing undue splasing. Also, although disclosed herein as useful in desulfurization, the lance apparatus of the invention may be used for other purposes, such as alloying or carrying out other chemical or physical operations. For example, magnesium, ferro-alloys and foundry metals, can be introduced into the metal for alloying and the like.

Dependent on the reactions that may occur within the vessel L there may be varying amounts of splashing and throwout of molten metal and/or slag. In such cases splash guard 8 protects that part of the lance apparatus located above the splash guard.

Figure 2:
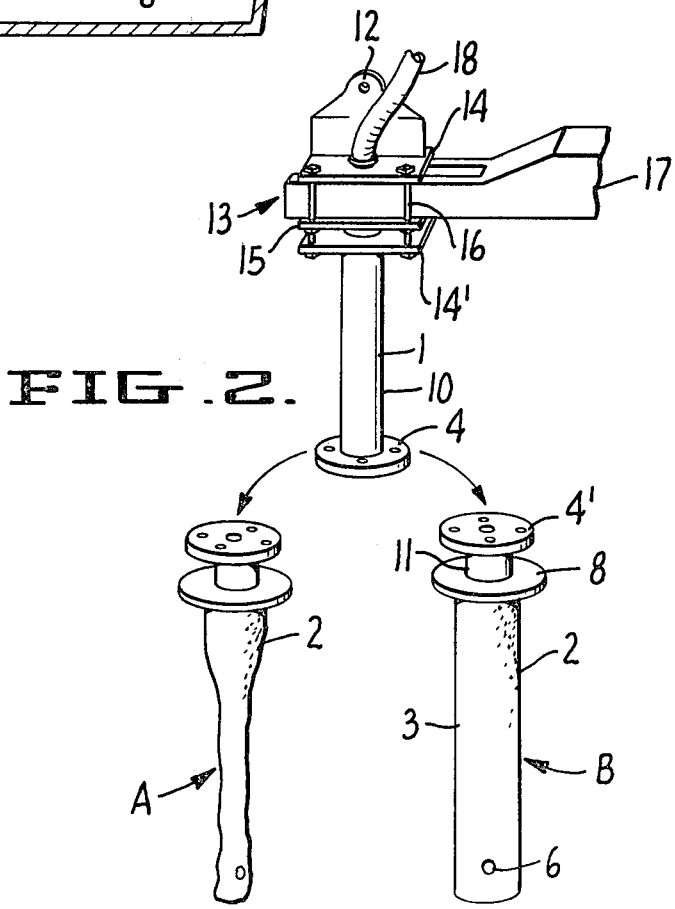
FIG. 2 is a perspective view of the upper section of the lance of the invention and of its lower section wherein A represents the lower section in a form with a worn refractory casing and B represents that form of the lower section with a fresh refractory casing.

After a period of time the refractory of lower lance section 2 becomes worn as shown in Form A of FIG. 2. By experience and visual inspection the operator is able to determine the need for replacement of refractory cover 3. Refractory wear depends on the nature of the refractory material, the bath conditions, length of use and other typical variables wherein refractories are used in direct contact with molten steel and other metals.

After completion of a desulfurization operation the entire lance apparatus is lifted from ladle L by lifting device 17 which is rotated at a pivot point or otherwise moved by conventional means (not shown) to a point clear of the ladle. Lower section 2A is then unfastened by releasing bolts 4 and 4' and a fully coated and refractory sheathed replacement lower section 2B is refastened to the lance apparatus assembly. The lance assembly can then be moved back to the ladle as required for further use.

The refractory material used in connection with the invention can be any suitable such material that is resistant to the metal being treated and the operation being carried out. Such refractories are normally magnesia or alumina or mixtures thereof. They are desirably used as castables or in any form well known to those skilled in the art.

During the processing operation cooling liquids or the like can be readily circulated, as heretofore mentioned, through the open or void areas within housings 10 and 11 which are concentrically arranged about lance pipe 9 to maintain it in a cooled condition and prevent deterioration thereof by high temperatures and the materials being processed. The cooling media used may by air, water or other liquids or gases.

In the embodiment shown herein the vessel containing the molten metal to be treated by the lance apparatus is a conventional ladle. It may also be a torpedo car or any other form of vessel that can be used to hold molten metal as it is held for use, transported or otherwise employed as a holder in a metal refining operation.

It is to be understood that the materials and equipment of the lance apparatus of this invention may be modified to suit the requirements of the operation to be carried out by the apparatus disclosed herein without departing from the spirit of this invention and the scope of the claims hereof.

What is claimed is:

1. Apparatus for use in the treatment of molten baths comprising, a vessel in the nature of a ladle containing molten metal to be treated, a lance suspended from above the surface of the molten metal and not forming part of the walls of said vessel, said lance comprising a separate upper section and a separate lower section adapted to be immersed in said molten metal, each of said sections having internal pipes extending along substantially the length thereof, fastening means for connecting said upper and lower sections at their respective abutting ends so that said pipes form a continuous internal passage along substantially the length of the lance, said lower section having a protective refractory sheath surrounding said internal pipe along the entire length of said section forming the outer wall thereof and a horizontally disposed flat plate positioned above said refractory sheath and extending radially outward to thereby serve as a splash guard for said upper section of said lance located above said guard, clamp means at the top of said upper section, means for engaging said clamp means for moving said lance into and away from said molten bath, and means for introducing materials through said internal pipe whereby materials for treating said bath may be introduced therein when said lower section is immersed in said bath.

2. The lance apparatus of claim 1 wherein the fastening means for connecting said upper section and said lower section comprise a pair of abutting plates which are sealed and bolted together to permit the said central lance pipes of each said section to be positioned in complete registry.

3. The apparatus of claim 1 wherein said upper and lower lance sections each have a housing concentrically arranged around the outside of said central lance pipes to thereby provide increased strength for said lance apparatus and permit cooling means to be employed in said housings to cool said central lance pipes.

4. The lance apparatus of claim 3 wherein said housing in said lower section extends only a portion of the length of said central lance pipe.

5. A lance apparatus adapted for suspension over a molten metal bath contained in a vessel and forming no part of the walls of said vessel, means for pneumatically injecting finely divided reagents into said bath of molten metal through said lance apparatus comprising: an upper section of said lance apparatus; a lower section of said lance apparatus, fastening means for connecting said upper section and said lower section, centrally disposed lance pipes within and extending the length of each of said upper and lower sections and abutting at said fastening means to thereby form a continuous lance pipe along the length of said lance apparatus when said sections are connected and permit separation of said sections upon disconnecting of said fastening means, means for feeding said reagents and a carrier gas at the top of said central lance pipe, orifice means at the base of said lower section whereby said reagent and said carrier gas are fed to said bath, a solid refractory sheath surrounding said lower section and forming a part thereof to thereby protect said section from direct contact with said molten metal, and a horizontally disposed flat plate positioned above said refractory sheath and extending radially outward to thereby serve as a splash guard for said upper section of said lance located above said guard.

6. Apparatus for use in the treatment of molten metal baths comprising, a vessel in the nature of a ladle containing molten metal to be treated, a lance suspended from above the surface of the molten metal and not forming part of the walls of said vessel, said lance comprising a separate upper section and a separate lower section adapted to be immersed in said molten metal, each of said sections having internal pipes extending along substantially the length thereof, fastening means for connecting said upper and lower sections at their respective abutting ends so that said pipes form a continuous internal passage along substantially the length of the lance, said lower section having a protective refractory sheath surrounding said internal pipe along the entire length of said section and forming the outer wall thereof, an adjustable clamp assembly at the top of said upper section, a lifting device for engaging said clamp assembly and moving said lance between a working position at said molten bath and an assembly position away from said molten bath, and means for introducing materials through said internal pipe whereby materials for treating said bath may be introduced therein when said lower section is immersed in said bath.

7. A lance apparatus for insertion in a molten metal bath contained in a vessel to inject finely divided reagents into said bath of molten metal and forming no part of the walls of said vessel, comprising: an upper section of said lance apparatus; a lower section of said lance apparatus, fastening means for connecting said upper section and said lower section, centrally disposed lance pipes within and extending the length of each of said upper and lower sections and abutting at said fastening means to thereby form a continuous lance pipe along the length of said lance apparatus when said sections are connected and permit separation of said sections upon disconnecting of said fastening means, housings respectively disposed in each of said upper and lower lance sections concentrically arranged around the outside of said central lance pipe to thereby provide increased strength for said lance apparatus and permit cooling means to be employed in said housings to cool said central lance pipe, means for feeding reagents and a carrier gas at the top of said central lance pipe, orifice means at the base of said lower section whereby said reagents and said carrier gas are fed to said bath, and a solid refractory sheath surrounding said lower section and forming a part thereof to thereby protect said section from direct contact with said molten metal.

8. The lance apparatus of claim 7 wherein said housing in said lower section extends only a portion of the length of said central lance pipe.

* * * * *